US005247730A

United States Patent [19]

Serafini

[11] Patent Number: 5,247,730

[45] Date of Patent: Sep. 28, 1993

[54] METHOD FOR ATTACHING AND BIDIRECTIONALLY TENSIONING A POROUS FABRIC OVER A FORM SUPPORT

[75] Inventor: Franco L. Serafini, Leudelange, Luxembourg

[73] Assignee: E. I. Du Pont de Nemours and Company, Wilmington, Del.

[21] Appl. No.: 995,515

[22] Filed: Dec. 21, 1992

Related U.S. Application Data

[62] Division of Ser. No. 782,939, Oct. 25, 1991, Pat. No. 5,206,981.

[51] Int. Cl.[5] ..... B67B 7/46

[52] U.S. Cl. ..... 29/449; 29/448

[58] Field of Search ..... 29/446, 448, 449

[56] References Cited

U.S. PATENT DOCUMENTS

| | | | |
|---|---|---|---|
| 2,310,391 | 2/1943 | Brooks et al. | 25/122 |
| 2,432,002 | 12/1947 | Frederick | 154/45.9 |
| 2,628,402 | 2/1953 | Billner | 25/30 |
| 2,671,940 | 3/1954 | Billner | 25/91 |
| 2,688,175 | 9/1954 | Billner | 25/154 |
| 3,102,751 | 9/1963 | Noble et al. | 294/65 |
| 3,477,103 | 11/1969 | Troth, Jr. | 19/163 |
| 3,600,771 | 8/1971 | Dyrander | 25/1 F |
| 3,726,950 | 4/1973 | Turzillo | 264/32 |
| 3,780,975 | 12/1973 | Turzillo | 249/1 |
| 3,821,062 | 6/1974 | Henderson | 161/59 |
| 3,826,485 | 7/1974 | Shindo | 271/106 |

(List continued on next page.)

FOREIGN PATENT DOCUMENTS

| | | |
|---|---|---|
| 53441 | 5/1912 | Austria . |
| 429730 | 6/1991 | European Pat. Off. . |
| 1-130907 | 5/1989 | Japan . |
| 1-198305 | 8/1989 | Japan . |
| 2-048477 | 2/1990 | Japan . |
| 2-128802 | 5/1990 | Japan . |
| 8909864 | 10/1989 | PCT Int'l Appl. . |
| 2156416 | 10/1985 | United Kingdom . |
| 2158767 | 11/1985 | United Kingdom . |

OTHER PUBLICATIONS

Chemical Abstracts, vol. 98, No. 6, 1983, Columbus, Ohio, U.S. Abstract No. 98:39727r "Japanese National Railways Aoki Constr. Co. Ltd.-Concrete Molding", p. 306, col. 2.

"Typar" Report 6, Dam Construction on the River Euphrates. A Smooth Improvement. (Nov. 1988).

IABSE Symposium Report, "Improvement of Surface Quality of Concrete Structures by Unique Formwork", Tanaka et al., (Sep. 1987).

Nikkei New Materials, No. 32, pp. 117-120, Aug., 1987 (partial translation 3rd row, line 9, p. 117-line 9, p. 118).

DuPont Zemdrain TM Bulletin (1990).

*Primary Examiner*—P. W. Echols

*Assistant Examiner*—David P. Bryant

[57] ABSTRACT

Apparatus and method for attaching and bi-directionally tensioning a porous fabric over a flexible, rectangular form support. The frame comprises a pair of rigid, parallel frame members connected by a pair of parallel cross members. The ends of the frame members contain legs that contact the form support in each corner thereof. Suction cups located on the cross members allow the form support to be attached to the frame and pulled towards the frame such that the edges of the form support flex between adjacent legs. Once the form support has been flexed, the porous fabric is wrapped over and attached to the form support at the corners and along all sides. After the porous fabric is completely attached to the form support, the frame is removed so the form support can return to its flat unflexed, rectangular dimensions. The result is that the porous fabric is bi-directionally stretched over the form support such that a uniform tension of 50 to 300 kg/lineal meter is created. The tensioned fabric and form support are useful in concrete formliner applications.

7 Claims, 1 Drawing Sheet

U.S PATENT DOCUMENTS

| | | | |
|---|---|---|---|
| 3,991,244 | 11/1976 | Debbas | 428/113 |
| 4,162,190 | 7/1979 | Ashworth | 162/359 |
| 4,213,926 | 7/1980 | Toyoda et al. | 264/74 |
| 4,243,301 | 1/1981 | Powell | 350/296 |
| 4,335,065 | 6/1982 | Ando | 264/87 |
| 4,439,273 | 3/1984 | Curry | 162/358 |
| 4,491,306 | 1/1985 | Eickhorst | 269/21 |
| 4,500,588 | 2/1985 | Lundström | 428/212 |
| 4,657,806 | 4/1987 | Dutt | 428/226 |
| 4,730,805 | 3/1988 | Yokota et al. | 249/113 |
| 4,761,326 | 8/1988 | Barnes et al. | 428/219 |
| 4,787,597 | 11/1988 | Yokota et al. | 249/113 |
| 4,851,281 | 7/1989 | Wood | 428/282 |
| 4,856,754 | 8/1989 | Yokota et al. | 249/113 |
| 4,863,792 | 9/1989 | Mrozinski | 428/315.5 |
| 4,877,679 | 10/1989 | Leatherman et al. | 428/224 |
| 4,882,217 | 11/1989 | Fitzpatrick | 428/212 |
| 5,124,102 | 6/1992 | Serafini | 264/86 |
| 5,135,692 | 8/1992 | Serafini | 264/86 |

METHOD FOR ATTACHING AND BIDIRECTIONALLY TENSIONING A POROUS FABRIC OVER A FORM SUPPORT

This is a division of application Ser. No. 07/782,939, filed Oct. 25, 1991, now U.S. Pat. No. 5,206,981.

FIELD OF THE INVENTION

The present invention relates to a fabric tensioning frame useful with forms for concrete manufacture where relatively smooth concrete surfaces are desired. More particularly, the invention relates to a fabric tensioning frame wherein the frame is attached to a flexible, rectangular form support and a porous fabric is attached and uniformly tensioned over the form support.

BACKGROUND OF THE INVENTION

In the manufacture of concrete structures, the concrete is usually cast using a form. The cast concrete takes the shape of that form. The wet concrete is poured into or against the concrete form and, upon setting of the concrete and removal of the form, the newly-exposed concrete surface is a reverse impression of the inner surface of the form. In the case of wooden forms, the concrete takes the appearance of the wood grain; and in the case of forms involving seamed form members, the concrete shows any seams which have not been sufficiently masked.

In addition, air is often added to a concrete mix and water is often added in excess of the amount required for hydration. Such air and water are useful to render the mix flowable and to facilitate handling and pouring. However, the excess water, if left undrained, results in concrete having a weak surface and, the air, if not removed, results in surface pores as large as 0.1 to 3 cm, which pores leave an uneven surface open to the effects of dirt and erosion by the freeze-thaw cycles of water.

One solution to eliminating seams and surface pores in the cast concrete is to tension a porous fabric over the inner surface of the form prior to casting the concrete. (The porous fabric is usually referred to as a formliner). Upon removal of the form, a relatively smooth surface is left on the cast concrete. Although this method and form have been disclosed in the applicant's co-owned, co-pending U.S. Pat. applications (U.S. Ser. No. 07/625,721 and U.S. Ser. No. 07/698,991), there is still a need for an apparatus and method that easily and unifomly tensions the porous fabric over the form. In these co-pending applications, the fabric is preferably tensioned by springs or elastomeric grippers that pull the fabric around the edges of the form.

When using these prior art tensioning methods, it is often difficult to obtain uniform bi-directional tension across the fabric and it is often difficult and time consuming to affix the fabric to the form, especially when out in the field where low temperature and wind may be present Clearly, what is needed is an apparatus and method for attaching and bi-directionally tensioning a porous fabric to a form that don't have the deficiencies inherent in the prior art. Specifically, the apparatus and method should allow fixation and tensioning of the fabric to the form in a shop thereby reducing the amount of work necessary in the field. Other objects and advantages of the present invention will become apparent to those skilled in the art upon reference to the attached drawing and to the detailed description of the invention which hereinafter follows.

SUMMARY OF THE INVENTION

In accordance with the invention, there is provided a frame for attaching and bi-directionally tensioning a porous fabric over a form support. In particular, the frame is used for tensioning a porous fabric over a substantially flat, flexible form support. In one aspect, the invention provides a frame for attaching and bi-directionally tensioning a porous fabric over a flexible, substantially rectangular form support, comprising:

(a) a rigid frame member having four legs extending therefrom, the legs extending in the same direction and substantially perpendicular to the frame member such that the area formed between the four legs takes the shape of a rectangle; and (b) means for attaching the frame member to the form support in the rectangular area formed between the four legs such that the form support is caused to evenly flex between adjacent legs of the frame member when attachment occurs.

In a preferred embodiment, the invention provides a frame for attaching and bi-directionally tensioning a porous fabric over a flexible, rectangular form support, comprising:

(a) a pair of rigid, parallel frame members having legs extending from each end thereof, said legs extending in the same direction and substantially perpendicular to the frame members;

(b) at least one rigid cross member connecting said parallel frame members; and (c) means for attaching said cross member to the form support such that the form support is caused to evenly flex between adjacent legs of the frame when attachment occurs.

The invention also comprises a method for attaching and bi-directionally tensioning a porous fabric over a flexible, rectangular form support, comprising the steps of:

(a) placing a flat, substantially rectangular form support over a porous fabric such that the fabric extends beyond the edges of the form support on all sides thereof;

(b) attaching a tensioning frame to the form support such that the edges of the form support are caused to flex towards the frame and away from the fabric when attachment occurs, the tensioning frame comprising:

(i) a pair of rigid, parallel frame members having legs extending from each end thereof, said legs extending in the same direction and substantially perpendicular to the frame members;

(ii) at least one rigid cross member connecting said parallel frame members; and (iii) means for attaching said cross member to the form support;

(c) attaching the porous fabric to the corners and edges of the form support while the form support is being flexed by the tensioning frame; and (d) removing the tensioning frame from the form support and flattening out the form support to its original dimensions so that the fabric is bi-directionally tensioned over the form support,.

BRIEF DESCRIPTION OF THE DRAWINGS

The invention will be better understood with reference to the following figure.

DETAILED DESCRIPTION OF THE PREFERRED EMBODIMENTS

Figure 1:
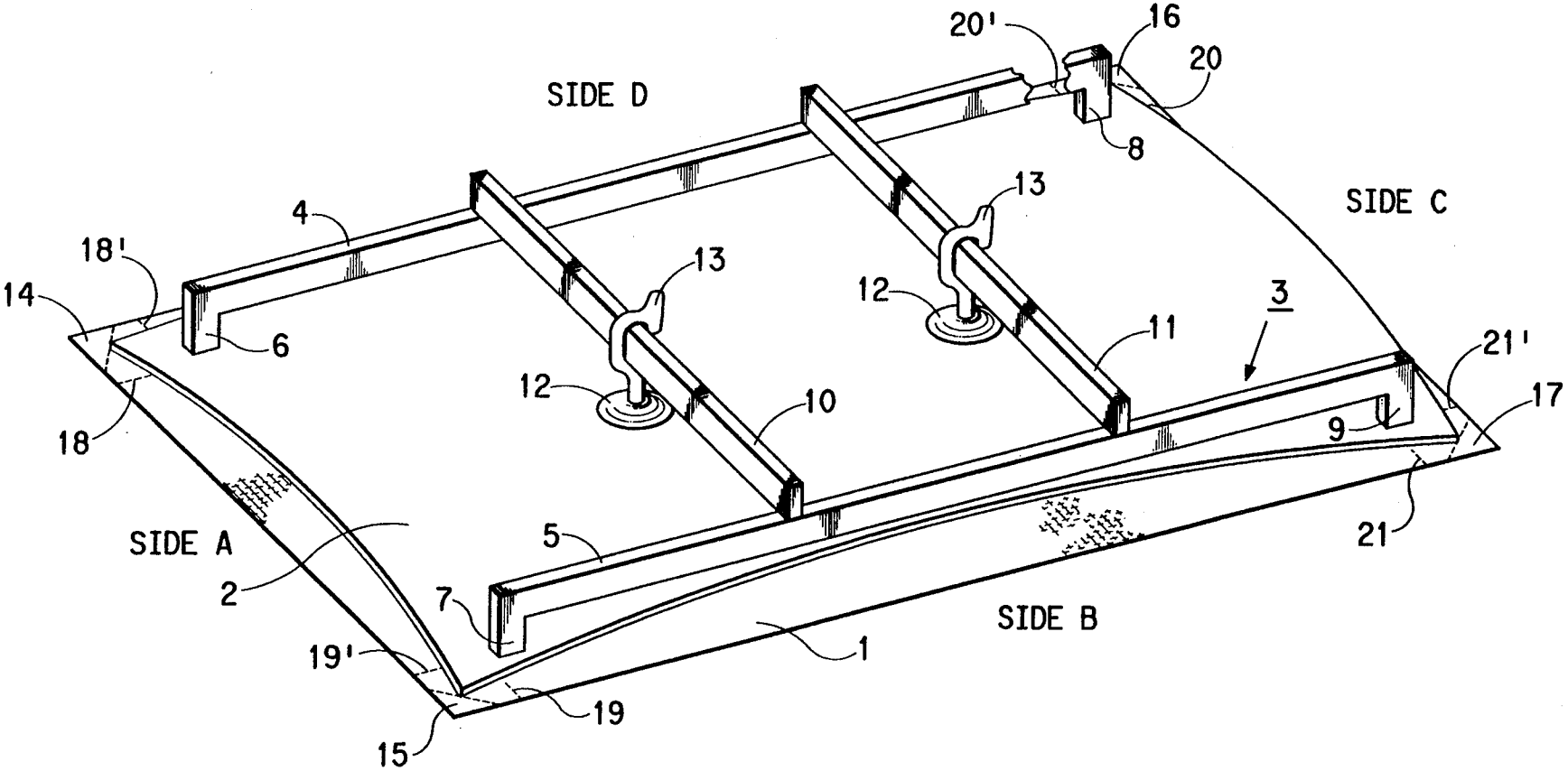
FIG. 1 is a schematic view of a concrete form support, a porous fabric and a preferred tensioning frame according to the invention.

Referring now to FIG. 1, a flexible, rectangular concrete form support 2, preferably plywood, is shown being flexed by a preferred tensioning frame 3 in both the x and y directions. The method of flexing the form support involves initially placing the form support 2 directly over a porous fabric 1 which has dimensions slightly larger than the dimensions of the form support. The form support 2, having sides A, B, C and D, should be flat and substantially rectangular and the fabric 1 should extend at least about 10 cm beyond the form support in all directions. The form support 2 can be made of wood or it can be of flexible metal or plastic; and, while it should be relatively smooth and flat, the smoothness is not critical.

It should also be understood that an optional grid (not shown) can be used to help in draining excess water away from the curing concrete. The grid is placed between the fabric 1 and the form support 2 and can be made of any noncompressible material such as wire screening or plastic netting. The grid can have holes of any regular or irregular shape defined by interconnecting spacing members. Any shape (e.g., round, square, triangular, or irregular) can be used, but it is essential that the area of the holes should be less than about 0.25 $cm^2$ so the fabric 1 can be drawn so taut that the fabric is not deformed enough by compaction pressure of the concrete mix to reach the surface of the form support 2. The grid should have a thickness of from about 0.2 to 50 mm. The limits of the thickness are a matter of convenience and practicality and are thus not critical. Typically, the thickness should be great enough to permit the flow of water and air from the body of wet concrete, yet not so thick that there is excess distance between the form support 2 and the fabric 1 juxtaposed with the grid. Greater detail concerning the use of an optional grid can be found in the applicant's co-owned, co-pending U.S. Pat. applications, U.S. Ser. No. 07/625,721 and U.S. Ser. No. 07/698,991, the entire contents of which are incorporated herein by reference.

Porous fabric 1 can be woven or nonwoven and can be made from natural or synthetic materials. The preferred material is a thermobonded polyolefin sheet material, such as polyethylene or polypropylene, having a basis weight of from about 70 to 600 $g/m^2$. A particularly preferred material is Zemdrain TM (a thermobonded polypropylene sheet material commercially available from Du Pont de Nemours, S. A., Luxembourg). However, other polymers can be used as a fabric material, such as PVC, polyester or any other polymer with sufficient chemical resistance when used in the basic environment of the fluid concrete. The fabric should have a pore size adequate to permit the passage of water and air, but inadequate to permit the passage of substantially all solid concrete particles in the mix. The fabric can be of any convenient thickness, but it must be adequate to withstand the high compaction pressures brought against it by the wet concrete. It is preferred that the porous fabric should be at least 0.5 mm thick.

When fabric 1 is held with continuous, uniform force in both the x and y directions, such that it is stretched uniformly over form support 2, a completely smooth concrete surface can be made. In prior art methods, making a completely smooth concrete surface is difficult due to problems in holding fabric 1 so it does not wrinkle during the concrete pouring process. Wrinkling occurs because form support 2 and fabric 1 may shrink or expand due to changes in temperature or humidity. It has been determined that as little as 0.1–0.2% of shrinkage or expansion in either the form support or the fabric is enough to cause wrinkles in the fabric and consequent irregularities in the concrete surface. It has also been determined that when the fabric 1 is fixed on a flat, relatively smooth form support 2, and when sufficient bi-directional tension is applied, the resulting cast concrete is absolutely flat, free of fold marks and of very high quality. For such smooth surfaces, continuous, uniform force must be applied to the expanse of fabric 1 in both the x and y directions. For purposes of the invention, a tension of 50 to 300 kg/lineal meter is deemed adequate.

In use, the fabric 1 to be attached and tensioned is laid on a flat table and a substantially rectangular plywood form support 2 of 6–12 mm thickness is placed on top of the fabric. The fabric 1 should be about 10–15 cm wider and longer than the plywood form support 2 in order that it can be wrapped around the edges of the plywood and attached thereto. A tensioning frame 3, preferably fabricated from metal, is then placed on top of the plywood form support 2 so that the ends of the frame will be about 8–10 cm inside the plywood form support's outer edges.

The frame 3 is comprised of a pair of rigid, parallel frame members 4 and 5. Each frame member has a leg (6, 7, 8 and 9) extending from each end thereof. The legs extend in the same direction and are substantially perpendicular to the frame member. The area formed between the legs should take the shape of a rectangle so that the legs will correspond with the corners of the rectangular form support. The legs must extend at least 5 cm from the frame so that there is enough clearance for the plywood form support 2 to be flexed. Preferably, the legs extend about 10–25 cm from the frame members. In this embodiment, the frame members are connected by one or more rigid cross members to ensure the parallel orientation of the frame members. In the preferred embodiment depicted in FIG. 1, two rigid, parallel cross members 10 and 11 are used to connect frame members 4 and 5.

Means are provided for attaching the cross members 10 and 11 to the plywood form support 2. Preferably, the attachment means comprises a pair of suction cups 12 that are individually mounted to each cross member by a locking clamp 13. In use, a suction bond is created between the suction cup and the form support 2 and then the form support, at these points of bonding, is lifted towards the cross members of the frame by the locking clamp 13. As the attachment is made, the edges of the form support 2 are flexed between adjacent legs of the tensioning frame 3.

The cross members 10 and 11 can be adjusted to be respectively at a distance from side C and A of the form support of about ½ the length of side A or C to get a similar flex or curvature of the form support in both the x and y directions. The tensioning frame 3 can advantageously be made using a square profile so that the length and width can be variable and adjustable with a sliding clamp for a wide range of rectangular form support dimensions. Typically, the frame 3 should be adjustable for a range of plywood form supports between 1.25 by 2.5 meters up to 2.5 by 5 meters. The form support at its points of suction bonding can be lifted from about 8–16 cm above the original flat position of the form support. By lifting up the form support, the form support corners have now moved inside the fabric in both the x and y directions.

It will be understood that the frame 3 can be embodied in many different shapes and profiles. For example, it is contemplated that in addition to having a square or rectangular profile, the frame may have a "U-shaped", "T-shaped" or circular profile and be suitable for purposes of the invention. Although these profiles may not be as easily adjustable as a square or rectangular profile, they still are deemed useful for purposes of the invention. What is essential to the invention is that the four legs of the frame define the corners of a rectangular area so that the legs correspond to the corners of the substantially rectangular form support.

The fabric corners (14, 15, 16, and 17) can now be cut out at 45 degrees to allow fabric bending in both the x and y directions. In addition, two cuts are made in the fabric (18, 18', 19, 19', 20, 20', 21 and 21') about 10–15 cm from the edge so that a fabric strip is obtained on each side of the fabric around each corner of the form support. The fabric strips can be turned up free from the rest of the fabric. (The cuts in the fabric should extend to just the outer edge of the flexed form support). Starting from sides B and D, the fabric strips near the corners of the form support are turned up tightly and wrapped around each of the form support corners. The fabric is firmly attached, preferably stapled or nailed, to the side of the form support in contact with the tensioning frame 3. Typically, at least 5–6 staples are required in each fabric strip to secure the strip to the form support corner. The form support is pushed down near the corner on the side of the fabric strip to straighten out the fabric. Once the fabric strips are evenly fixed on the four corners of sides B and D, the same can be done on sides A and C. Once all corners attachments are made, the form support can be pushed down on side A so that the full length of the fabric can be turned up and wrapped around the edge of the form support on side A. The fabric is then stapled to the form support (a staple every 5–10 cm) all along side A. The same procedure is followed for side C and then for sides B and D.

After the fabric has been completely attached to the form support along all 4 sides, the tensioning frame 3 is removed by loosening the suction cups from the center of the form support. The fabric is now fixed and the tension can be built up in both the x and y directions by pushing down on the center of the form support. It can be seen that the invention allows a porous fabric to be fixed to a plywood form support so that upon removing the tensioning frame from the form support and flattening out the form support to its original rectangular dimensions, the fabric will have an imposed and controllable elongation which can result in very high bi-directional tension on the fabric up to about 300 kg/lineal meter. A plywood form support with a fabric liner can be very easily and quickly fixed to any type of formwork which can be used to achieve superior concrete properties. When a porous fabric like Zemdrain TM was fixed on a 1.25 by 2.5 meter plywood form support using the inventive apparatus and method, a real elongation of 3 and 6 mm was measured in the respective x and y directions. This amount of elongation required a tension of about 100 kg/lineal meter.

Particular advantages of the preferred embodiments over prior art tensioning apparatus and methods include:

(1) proper fabric fixation can be made in a shop where it is easier and more reliable;

(2) the fabric can be changed on the job site since fixation is easier and requires less skill than prior art methods;

(3) the flexible plywood form support and fabric can be used on any type of formwork (e.g., wood or steel) without the need for additional specialized tools; and (4) the flexible plywood form support can be reused a large number of times after removing and replacing the used porous fabric.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

I claim:

1. A method for attaching and bi-directionally tensioning a porous fabric over a flexible, rectangular form support, comprising the steps of:

(a) placing a flat, rectangular form support over a porous fabric such that the fabric extends beyond the edges of the form support on all sides thereof;

(b) attaching a tensioning frame to the form support such that the edges of the form support are caused to flex towards the frame and away from the fabric when attachment occurs, the tensioning frame comprising:

(i) a pair of rigid, parallel frame members having legs extending from each end thereof, said legs extending in the same direction and substantially perpendicular to the frame members;

(ii) at least one rigid cross member connecting said parallel frame members; and (iii) means for attaching said cross member to the form support;

(c) attaching the porous fabric to the corners and edges of the form support while the form support is being flexed by the tensioning frame; and (d) removing the tensioning frame from the form support and flattening out the form support to its original dimensions so that the fabric is bi-directionally tensioned over the form support

2. The method of claim 1 wherein there are a pair of parallel cross members connecting the parallel frame members.

3. The method of claim 1 wherein the form support comprises plywood.

4. The method of claim 1 wherein the porous fabric: is comprised of a thermobonded polyolefin sheet material

5. The method of claim 1 wherein the polyolefin is selected from the group consisting of polypropylene and polyethylene.

6. The method of claim 1 wherein the fabric is tensioned over the form support at 50 to 300 kg/lineal meter in both its lengthwise and widthwise directions.

7. A method for attaching and bi-directionally tensioning a porous fabric over a flexible, rectangular form support, comprising the steps of:

(a) placing a flat, rectangular form support over a porous fabric such that the fabric extends beyond the edges of the form support on all sides thereof;

(b) attaching a tensioning frame to the form support such that the edges of the form support are caused to flex towards the frame and away from the fabric when attachment occurs, the tensioning frame comprising:

(i) a rigid frame member having four legs extending therefrom, the legs extending in the same direction and substantially perpendicular to the frame member such that the area formed between the four legs takes the shape of a rectangle; and (ii) means for attaching the frame member to the form support in the rectangular area formed between the four legs;

(c) attaching the porous fabric to the corners and edges of the form support while the form support is being flexed by the tensioning frame; and (d) removing the tensioning frame from the form support and flattening out the form support to its original dimensions so that the fabric is bi-directionally tensioned over the form support.

* * * * *